US006988856B2

(12) United States Patent
Schellhorn

(10) Patent No.: US 6,988,856 B2
(45) Date of Patent: Jan. 24, 2006

(54) LARGE SCALE SOIL PROCESSING TOOL FOR USE WITH A PREFORMED SACRIFICIAL GUIDE

(76) Inventor: Verne L. Schellhorn, 32987 Hwy. 1 South, Gualala, CA (US) 95445

( * ) Notice: Subject to any disclaimer, the term of this patent is extended or adjusted under 35 U.S.C. 154(b) by 0 days.

(21) Appl. No.: 10/813,151

(22) Filed: Mar. 29, 2004

(65) Prior Publication Data

US 2004/0244998 A1 Dec. 9, 2004

Related U.S. Application Data

(60) Provisional application No. 60/461,690, filed on Apr. 8, 2003.

(51) Int. Cl.
*E02D 5/30* (2006.01)
*E02D 5/54* (2006.01)

(52) U.S. Cl. ..... 405/240; 405/266

(58) Field of Classification Search ..... 405/231, 405/240, 258.1, 266, 270
See application file for complete search history.

(56) References Cited

U.S. PATENT DOCUMENTS 6,183,166 B1 * 2/2001 Schellhorn ..... 405/233

* cited by examiner

*Primary Examiner*—Thomas B. Will
*Assistant Examiner*—Tara L. Mayo
(74) *Attorney, Agent, or Firm*—Bruce H. Johnsonbaugh

(57) ABSTRACT

A method is provided for centering and guiding a large diameter soil processing tool. A sacrificial guide is formed by using a small diameter soil processing tool to form a soil-cement column having a relatively hard outer section and a relatively soft center section. The relatively hard outer section is utilized to guide the large diameter soil processing tool. In one embodiment, the soft central region of the sacrificial guide is left in place and the pilot of the large tool carries an auger that simply drills through the central portion of the sacrificial guide. In a second embodiment, the sacrificial guide is hollow and the large tool need not have an auger at the tip of its pilot. The large tool advances downwardly through the sacrificial guide and, as it advances downwardly, the large tool breaks up the sacrificial guide and the sacrificial guide particles ultimately form a portion of the soil-cement column formed by the large soil processing tool. The method facilitates the use of soil processing tools having diameters of 8 to 20 feet, for example. Large volumes of subterranean material may be hardened or solidified by using an array of the sacrificial guides to precisely control and center the large processing tool so that the large quantities of subterranean material such as utilized to support an airport runway may be processed efficiently with the invention. The method is also usable with soil processing tools of any diameter.

3 Claims, 13 Drawing Sheets

LARGE SCALE SOIL PROCESSING TOOL FOR USE WITH A PREFORMED SACRIFICIAL GUIDE

CROSS-REFERENCE TO RELATED APPLICATION

This application claims the benefit of and priority from U.S. provisional application Ser. No. 60/461,690 filed Apr. 8, 2003.

BACKGROUND AND BRIEF DESCRIPTION

The present invention relates generally to soil processing tools and a method of using soil processing tools on a larger scale than known in the prior art for modifying the structural integrity of material in a subterranean earth situs. More particularly, the present invention is provided for use in large scale projects where the structural integrity of vast amounts of subterranean soil is to be processed. The invention also provides a method of forming precision soil-cement columns of any diameter by forming a sacrificial guide which centers and guides the soil processing tool.

Soil processing tools have been used in the prior art in building foundation systems, load bearing walls and also for soil modification. Soil modification is a broad concept which includes without limitation the solidification or hardening of various subterranean sites for a variety of purposes. At present, the tools used for underground soil modification are typically between three and five feet in diameter. Attempts to use any large scale soil processing tools, i.e., with diameters greater than about 5 feet, are complicated by the fact that it is difficult to control such large tools and to create perfectly vertical soil cement columns with them. For example, the forming of vertical columns on precise centers is critical if the soil processing project includes the hardening of a large volume of material for supporting an airport runway, or the solidification of a radioactive underground plume.

The present invention provides for the first time a large scale processing tool having a diameter of between 8 and 20 feet (and perhaps larger) but which can be controlled and guided to form precision vertical holes and soil cement columns centered at precise locations. The present invention accomplishes this result in part by the use of one or more preformed sacrificial guides. The preformed sacrificial guide cooperates with a pilot in the much larger soil processing tool to assure that the larger tool remains centered and bores downwardly in essentially a perfectly vertical path. By using the preformed sacrificial guide, large arrays of soil cement columns may be formed in processing large volumes of underground earth sites. In many of these large underground sites, it is critical that the entire volume of the underground site be either solidified into a rather solid soil cement mixture or thoroughly processed to assure a uniform result. For example, for support of an airport runway, the underground material beneath the runway must have uniform strength. As another example, in treating a large underground radioactive plume, it is critical that the entire volume of the plume be solidified or otherwise treated to minimize future movement of the radioactive materials in underground water tables.

The present invention also provides for the first time a method for forming soil-cement columns of any diameter that have very precise verticality and precise centering. This high degree of precision is achieved by using a sacrificial guide to position and guide the soil processing tool.

The present invention contemplates the use of some aspects of my prior patents, including U.S. Pat. Nos. 4,793, 740; 4,958,962; 5,396,964; 6,183,166 and 6,241,426, all of which are incorporated by reference as though set forth in full herein.

Portions of those prior patents are utilized in conjunction with the present invention and some significant portions of those prior patents will be described herein as they pertain to the present invention.

The overall concept of the present invention is to first form a sacrificial guide with a soil cement mixture and allow the guide to harden sufficiently to act as a pilot for a larger soil processing tool. The pilot shaft of the larger soil processing tool is centered in and guided by the preformed sacrificial guide as the large processing tool begins moving downwardly. As the soil processing tool moves downwardly, its heavy, rotating teeth break up and fragment the sacrificial guide into soil cement particles so that the soil cement mixture utilized to form the sacrificial guide is eventually interspersed into the much larger soil cement column formed by the large scale processing tool. The result is a precisely placed, large diameter and homogeneous soil cement column. An array of such columns can be placed very accurately in order to solidify or otherwise process very large underground sites.

The sacrificial guide may be either a hollow or a solid cylinder and formed, for example, by the technique taught in my U.S. Pat. No. 6,183,166. If the sacrificial guide is hollow, the pilot of the larger soil processing tool is centered and guided by the hollow sacrificial guide. If the sacrificial guide is a solid cylinder, it has a relatively soft center and a relatively hard outer region. In this embodiment, the larger soil processing tool has a pilot which is tipped with an auger. The auger drills out the soft center of the guide, but is simultaneously centered and guided by the hard, outer region of the guide.

A primary object of the invention is to provide a method for hardening or solidifying large volumes of material located in a subterranean earth situs so that the earth situs may be used to support structures carrying large loads such as airport runways.

Another object of the invention is to provide a method for forming underground soil-cement columns of any diameter wherein the columns are formed by using a sacrificial guide and the resultant columns have a higher degree of verticality and more precise centering than known in the prior art.

A further object is to provide a method of forming underground soil-cement columns utilizing a soil-cement sacrificial guide, wherein the guide becomes broken up and fragmented to form a part of the resultant soil-cement column.

Another object of the invention is to provide a method for forming a sacrificial guide which centers and guides a large diameter soil processing tool having a diameter of more than 8 feet which can be controlled and guided to form precision vertical soil-cement columns centered at precise locations.

A further object is to provide a method for hardening or solidifying large subterranean volumes of material wherein an array of sacrificial guides is formed and those sacrificial guides are used to guide and control large diameter soil processing tools to form soil-cement columns in the situs.

Other objects and advantages of the invention will become apparent from the following description of the drawings wherein:

DETAILED DESCRIPTION OF THE DRAWINGS

FIGS. 1–5 show the formation of the sacrificial guide using essentially the technology shown and described in U.S. Pat. No. 6,183,166 dated Feb. 6, 2001. Certain portions of that disclosure are repeated herein for reference.

Figure 1:
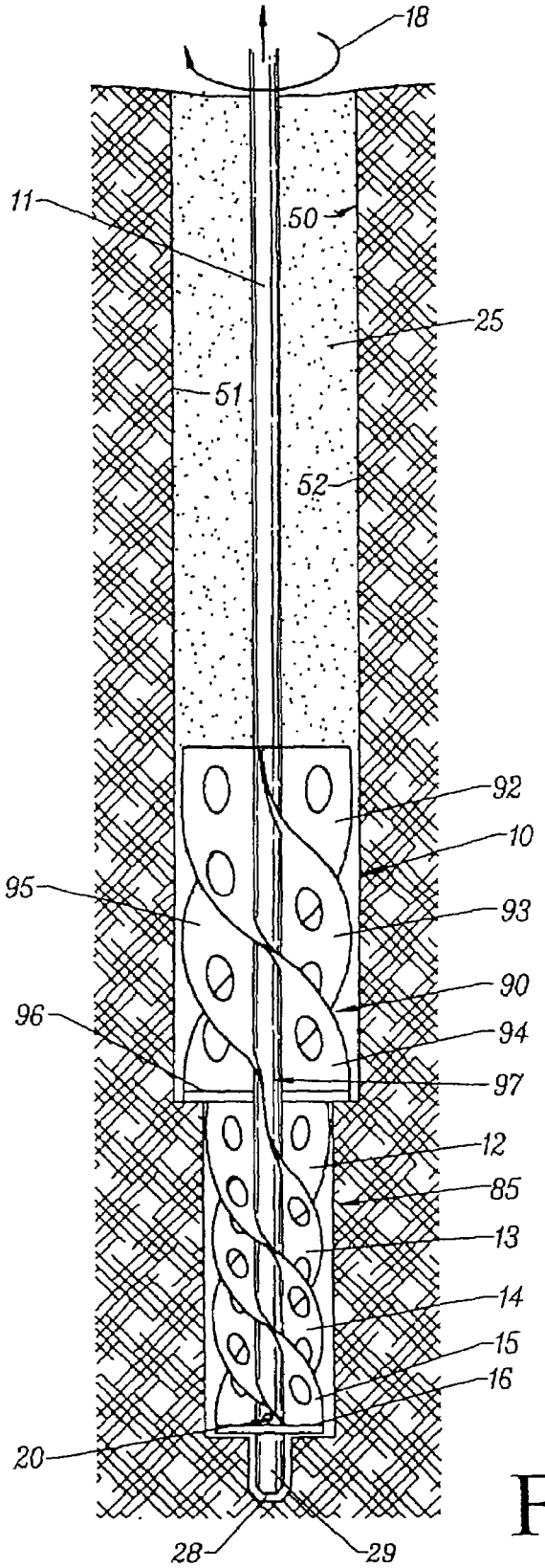
FIG. 1 illustrates a small diameter soil processing tool forming a soil-cement column as it advances downwardly and forms a hole by mechanically and hydraulically dividing the material in the hole created by the tool.
Figure 2:
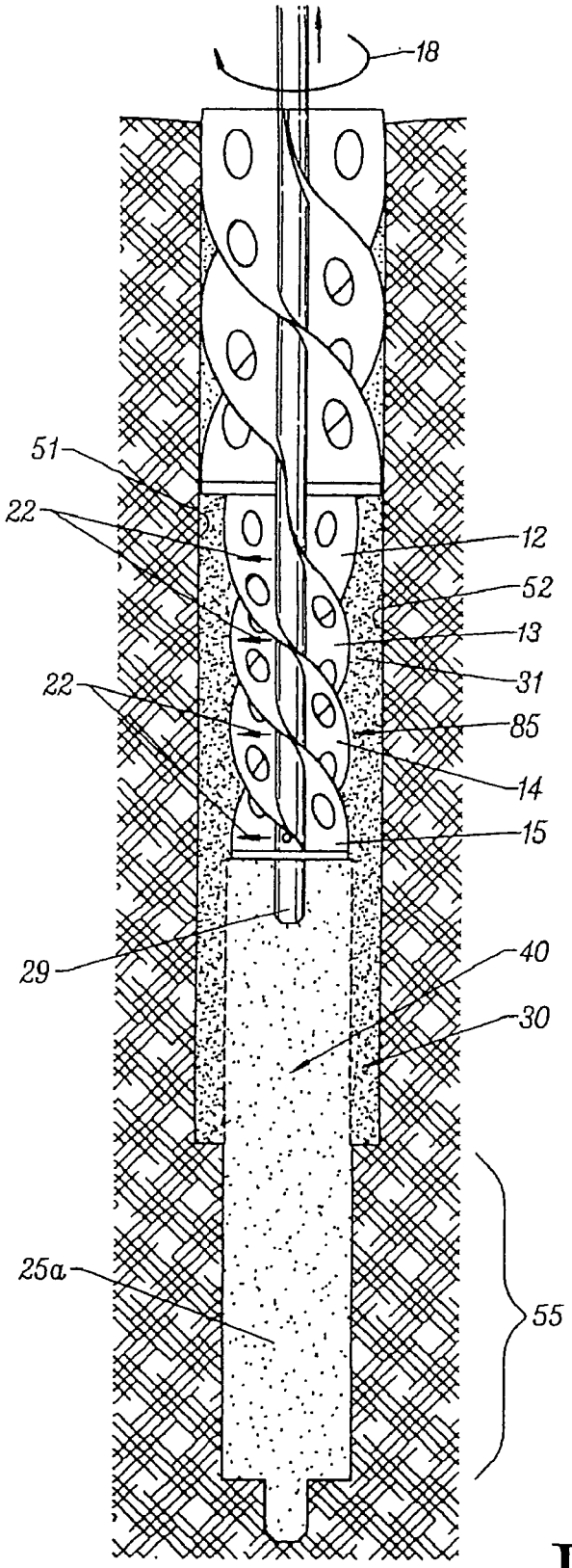
FIG. 2 illustrates the auger shaped soil processing tool as being withdrawn and vigorously rotated to form a relatively hard outer casing and relatively soft inner portion of the soil-cement column.
Figure 3:
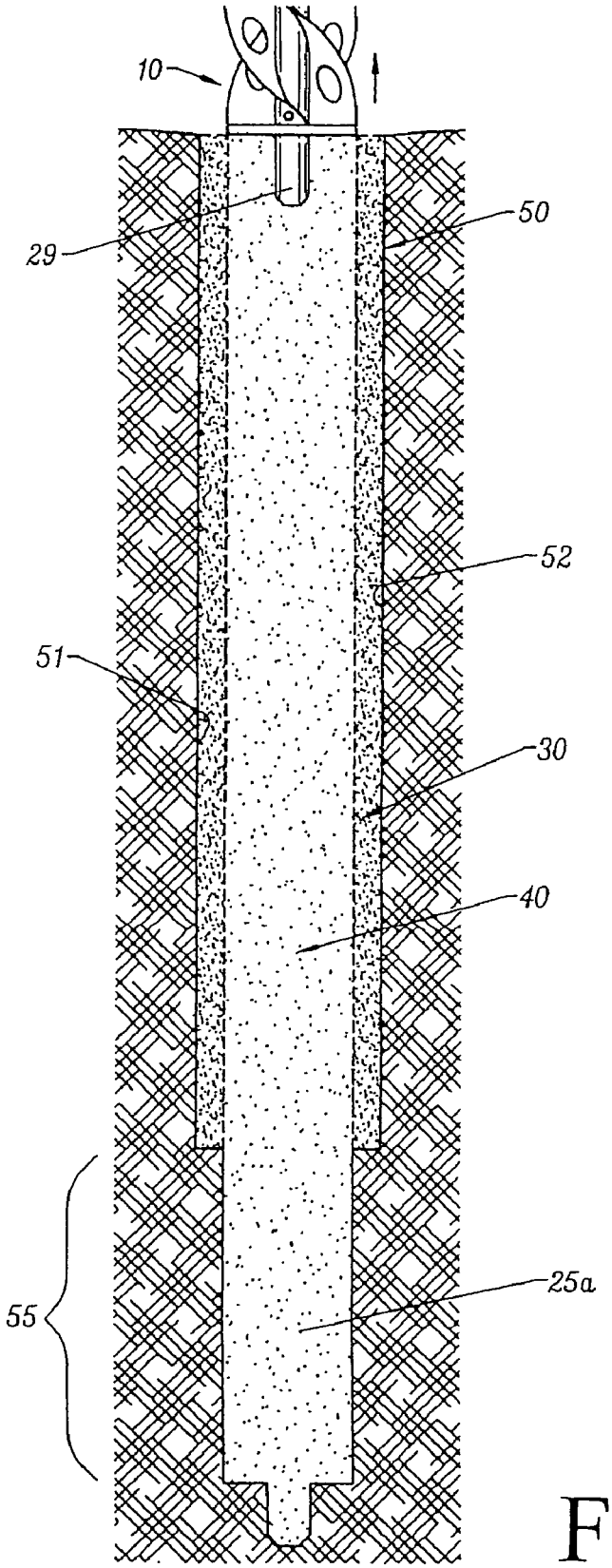
FIG. 3 illustrates the soil-cement column having an outer relatively hard region and an inner relatively soft region.

As shown in FIGS. 1–3, a small diameter soil processing tool 10 is provided having a hollow stem 11, a first stage 85 and second stage 90. As used herein and in the claims, the phrase "small diameter" means a diameter of tool 10 between 1 and 5 feet. First stage 85 has four helical flights 12,13,14 and 15 and cutting tip 16. Cutting tip 16 typically has cutting teeth known in the art; cutting teeth are not shown in the drawings for clarity. Helical flights 12–15 are preferably as shown and described in greater detail in FIG. 12 of U.S. Pat. No. 5,396,964, owned by the assignee of the instant application. U.S. Pat. Nos. 5,396,964; 4,793,740 and 4,958,962 are hereby incorporated by reference as if set forth in full. The second stage 90 has four helical flights 92,93,94 and 95. The outer diameter of helical flights 12–15 of the first stage 85 is smaller than the outer diameter of helical flights 92–95 of second stage 90. The second stage 90 has a wear resistant cutting surface 96 similar to cutting tip 16 and nozzle 97 through which cement slurry is pumped.

Nozzle means 20 is located near cutting tip 16 and allows the introduction of a cement slurry under pressure which combines with the soil being dug by rotation of tool 10. The cement slurry is preferably a mixture of Portland cement and water having a density of greater than 12.0 pounds per gallon. Greater densities of the cement slurry can be achieved by utilizing more Portland cement. Greater densities of the cement slurry are required where the soil is relatively dense. As described in greater detail in U.S. Pat. Nos. 4,793,740; 4,958,962 and 5,396,964, the cement slurry is introduced as high pressure jets to achieve velocities of 300 ft/sec to 2500 ft/sec. The jets are sufficiently strong to reduce pieces of soil created by the auger to particles small enough to form a mixture with the cement slurry. It is to be understood that in FIGS. 1 and 2, the soil cement mixture 25 extends to the bottom of hole 50.

The present methodology of advancing the soil processing tool or auger 10 and breaking the soil into particles is preferably as shown in greater detail in U.S. Pat. No. 4,958,962. As shown in FIG. 1, the tool 10 is rotated in the clockwise direction as shown by arrow 18 as the tool is being driven downwardly into hole 50.

A pilot bit 29 is connected to the lowermost end of hollow stem 11. The pilot bit preferably has a nozzle 28 formed in its lower tip; the pilot bit providing directional stability for the tools that follow.

Figure 11:
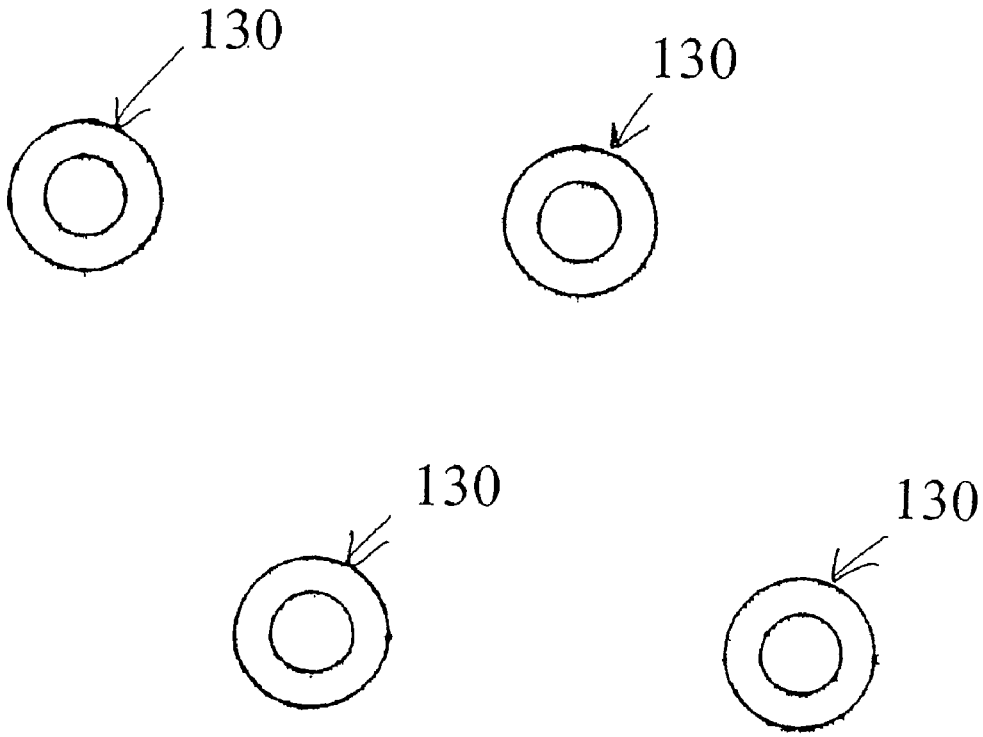
FIG. 11 illustrates an alternate array of sacrificial guides wherein the centers of any three adjacent sacrificial guides form an equilateral triangular.

In accordance with the present invention, when the proper depth of hole 50 has been achieved, as shown in FIGS. 1 and 2, the tool 10 is rotated vigorously in either direction. As shown in FIG. 2, the auger-shaped tool 10 is rotated in a clockwise direction as shown by arrow 18 as it is being lifted upwardly out of hole 50. The tool is rotated at a sufficiently high speed to generate a force of two G's or more along the outer edge of flights 12–15 of first stage 85. Those centrifugal forces tend to drive the denser cementitious and soil particles towards the outer edges or side walls 51 and 52 of hole 50 into the annular region 31 between first stage 85 and side walls 51 and 52, as shown schematically by arrows 22 in FIG. 3 and as described in U.S. Pat. No. 6,183,166. Rotational speeds for tools of various diameters to achieve two G's are shown in FIG. 11 of U.S. Pat. No. 5,396,964.

As shown in FIG. 2, as the auger-shaped tool 10 is being withdrawn and vigorously rotated, a first cylindrical region 30 is formed at the outer edges of hole 50 which contains a relatively high proportion of the denser soil and cementitious solids and a smaller proportion of free water compared to the lighter soil particles and free water that remain in the second central region 40. The second cylindrical region 40 is simultaneously formed at the center of hole 50 and has a greater proportion of free water and is softer than the first region 30. When the auger-shaped tool is rotated as shown in FIG. 2, at a sufficient rotational speed to cause in excess of two G's at the outer diameter of first stage flights 12–15, and if the cement-slurry is approximately 20% of the volume of hole 50, the eventual strength of the first region 30 in sandy soil is approximately 1,000 psi and the resultant strength of the second region 40 is approximately 200 psi.

The smaller diameter of the first stage 85 serves to form an annulus 31 (FIG. 2) between first stage 85 and side walls 51 and 52 of hole 50, which allows the undisturbed accumulation of centrifugally placed denser solids which ultimately form the soil-cement casing of the present invention. The smaller diameter first stage is intended to maximize the separation of denser cementitious and soil particles from lightweight soil particles and water.

Figure 4:
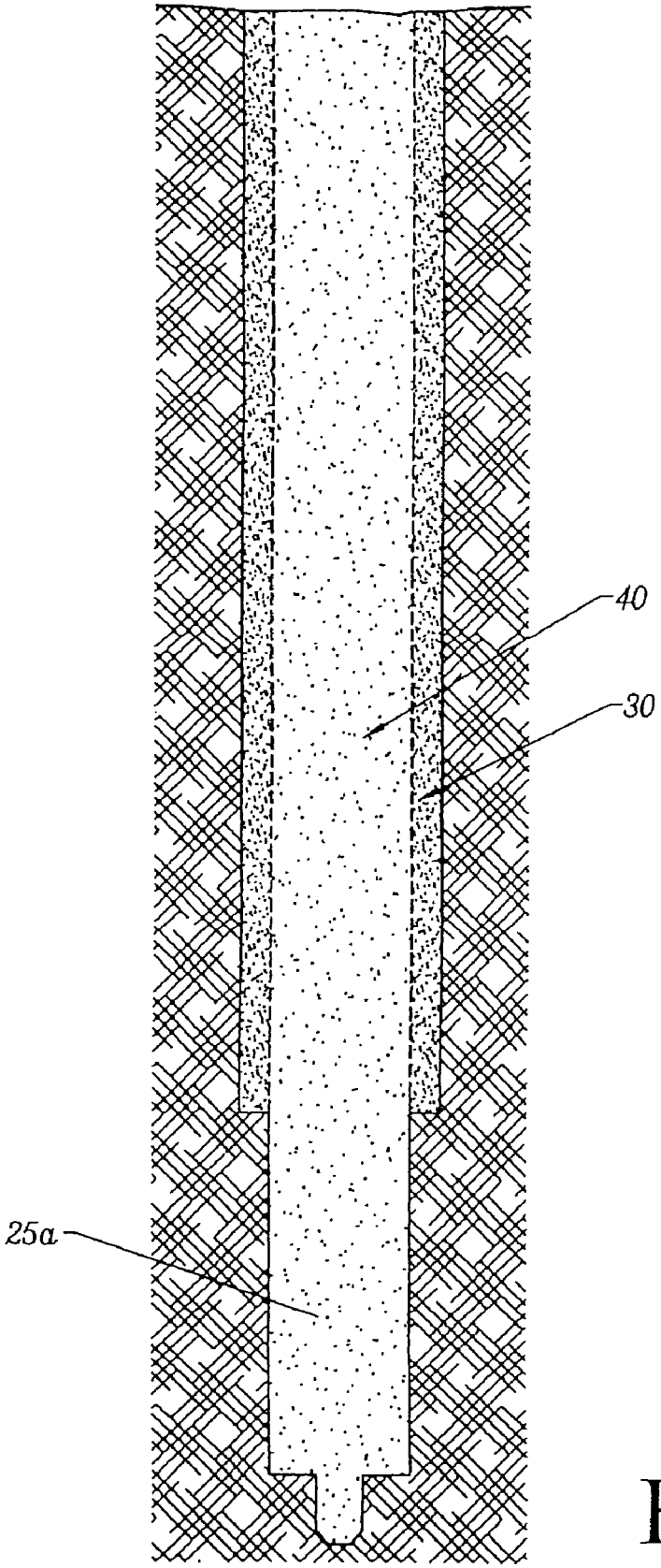
FIG. 4 shows the hole after the soil-cement has been allowed to set up.
Figure 5:
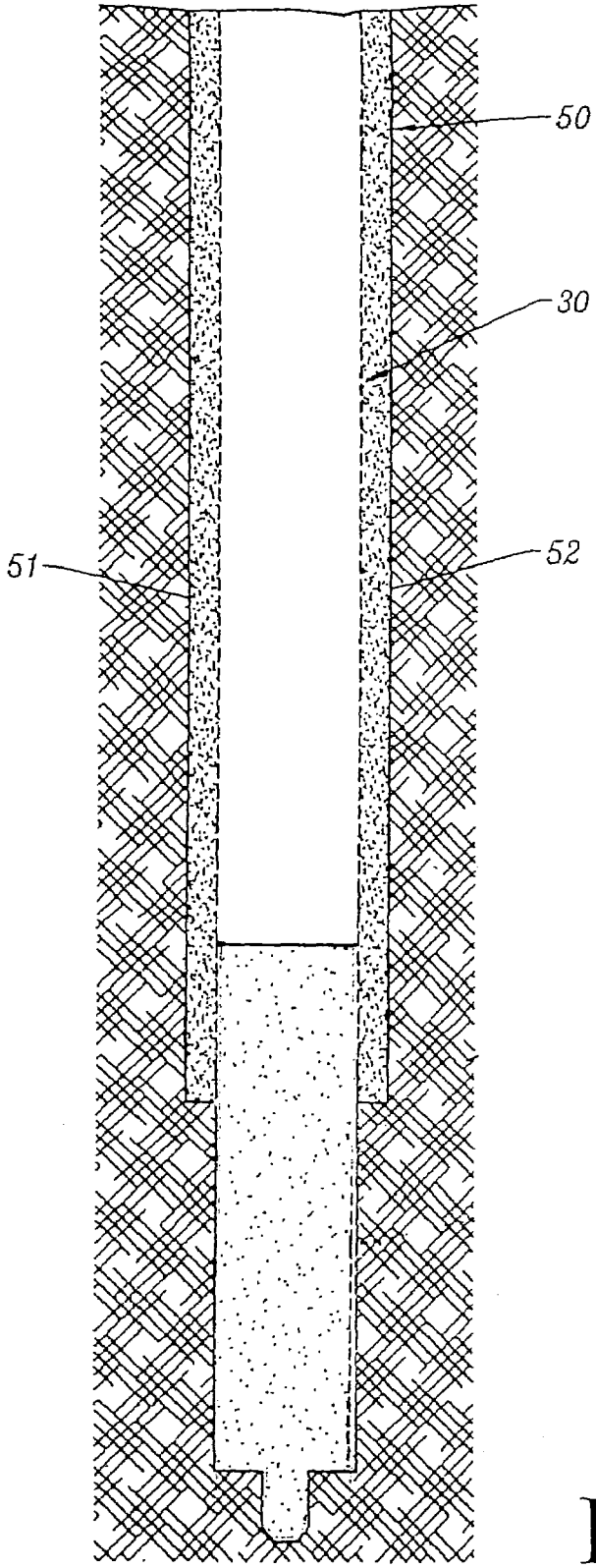
FIG. 5 illustrates one embodiment of the invention wherein the softer center region has been drilled out to form a hollow underground casing.

FIG. 3 shows the tool 10 after it has been removed completely from hole 50. The soil-cement mixtures in the first region 30 and second region 40 are allowed to dry and harden. FIG. 4 shows the soil-cement mixture in hole 50 after it has set up. As shown in FIG. 5, a smaller auger 9 has been utilized to drill into and remove the softer soil-cement mixture from second region 40. The smaller auger will tend to remain centered in region 40 because the harder soil cement in first region 30 keeps it centered. After removal of the soil-cement mixture from the second region 40, a resultant subterranean cylindrical and hollow casing 30 remains in place as shown in FIG. 5. The hollow casing comprises the hardened soil-cement mixture in first region 30.

After hollow casing 30 has been drilled out, the verticality of casing 30 may be measured by inclinometers or other known techniques. By confirming the verticality of each casing 30, the verticality of the large soil cement columns is assured. This quality control is a critical aspect in underground support for airport runways or in treating underground radioactive plumes, for example.

Figure 6:
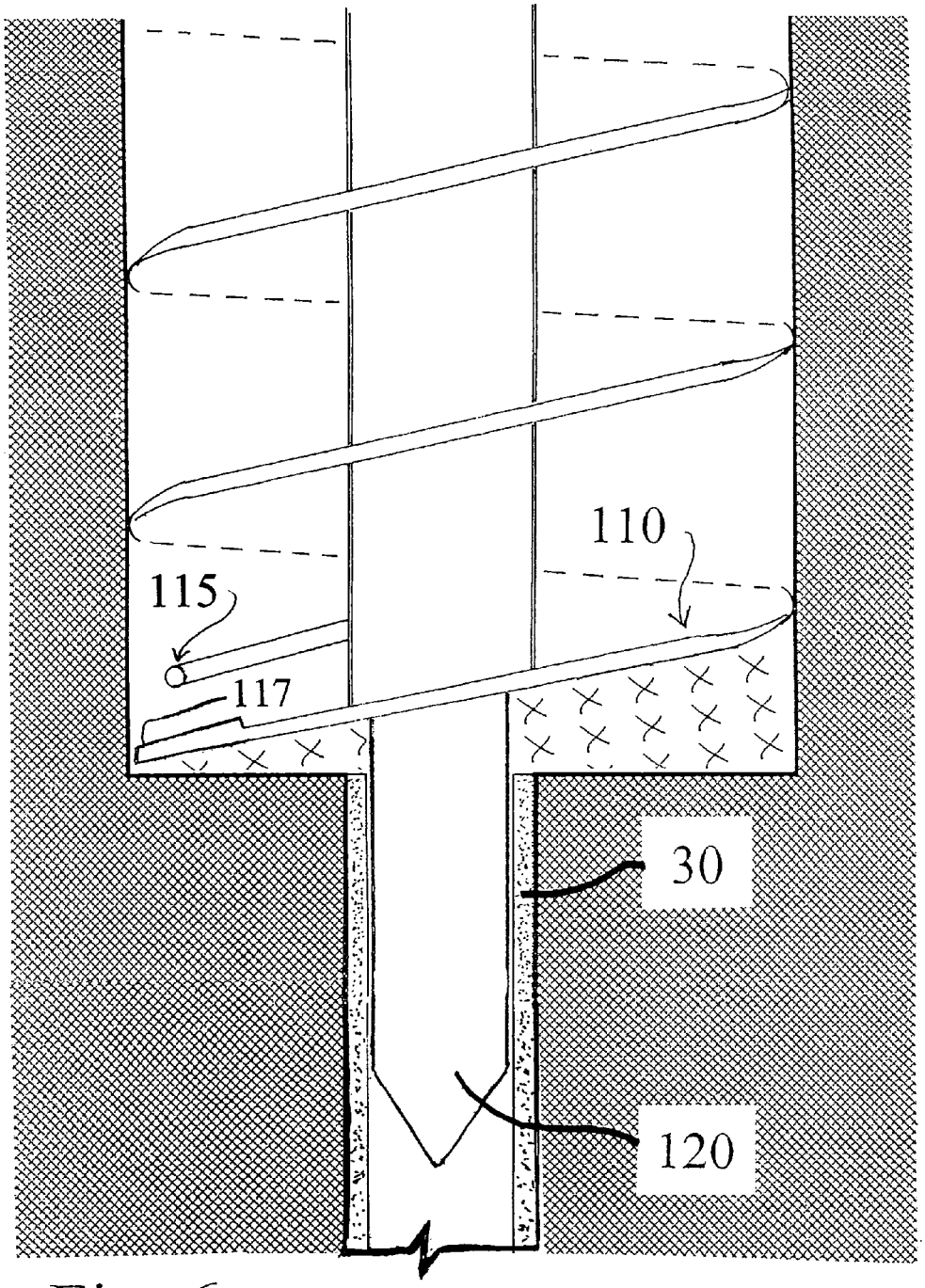
FIG. 6 illustrates the introduction of a very large soil processing tool having a pilot wherein the pilot is centered by and guided by the hollow underground casing illustrated in FIG. 5.

FIG. 6 illustrates the use of a large soil processing tool 110, having a diameter of from three to twenty feet, for example, being used in conjunction with the hollow, preformed casing 30 which acts as a sacrificial guide. As used herein and in the claims, the phrase "large diameter" refers to a tool such as 110 with a diameter greater than that of the sacrificial guide. The present invention is capable of precisely centering and guiding large soil processing tools having a diameter as large as from 8 to 20 feet. The large tool 110 has a pilot 120 which is guided into the drilled out, hollow casing 30 at ground level. As heavy tool 110 begins to rotate, its teeth will break apart and fragment the soil-cement casing 30 as it moves downwardly into the soil. Nozzle 115 directs slurry at high velocities into the material. Cutting tip 117 mechanically breaks the material, slurry from nozzle 115 hydraulically reduces the fragments into particles. As shown in FIG. 6, the large tool 110 has extended downwardly into casing 30.

As an alternate form of the invention (see FIG. 13), casing 30 may be left with its soft center region 40 in place, and the pilot of the large tool 110 is tipped with an auger. The auger tipped pilot drills out the soft center 40 of casing 30 as the large tool 110 advances.

Figure 7:
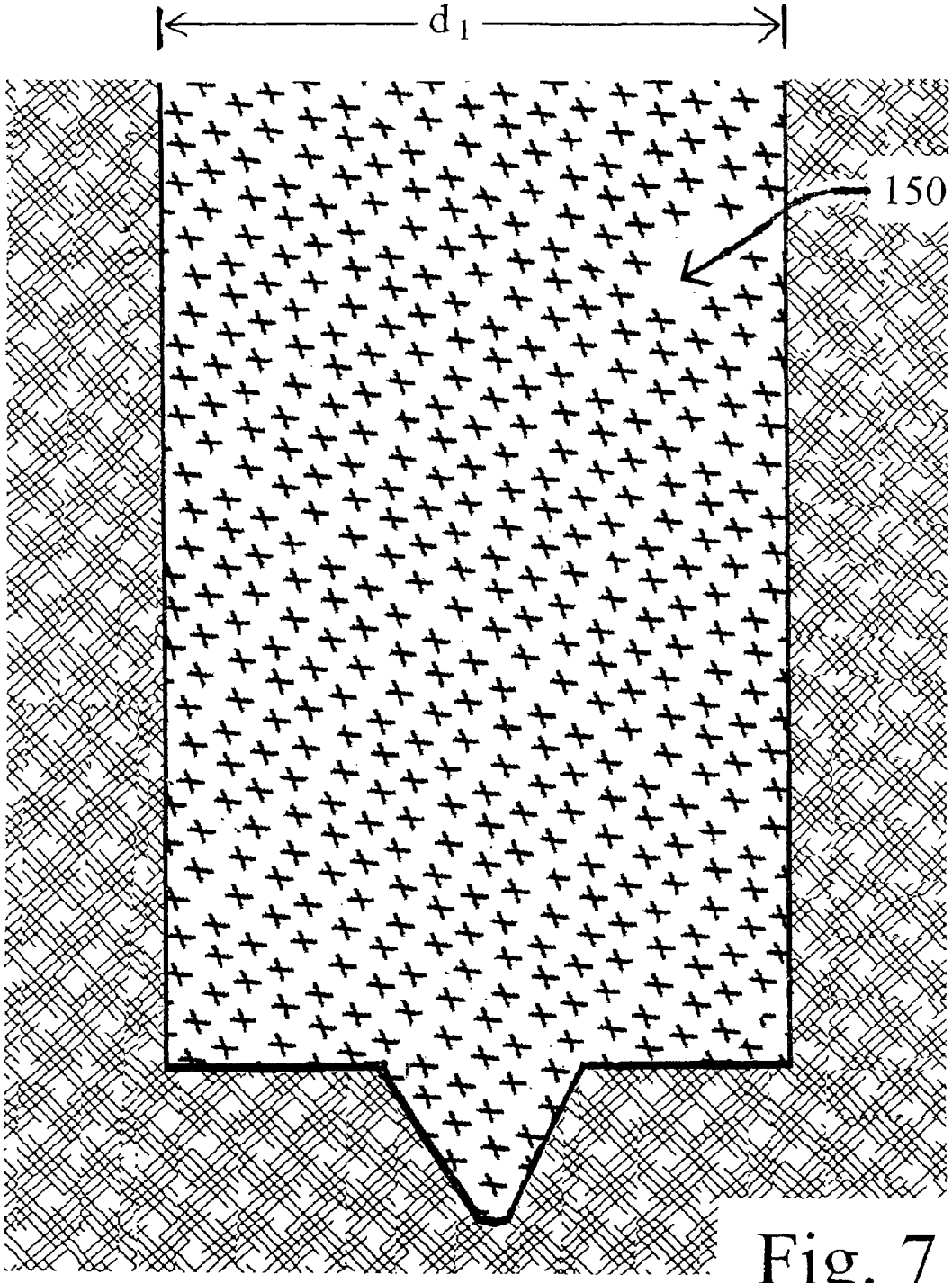
FIG. 7 illustrates a large soil-cement column left by the large diameter soil processing tool after it has been withdrawn.

As illustrated in FIG. 7, tool 110 has been withdrawn and a soil-cement column shown generally as 150 has been formed having a diameter of d, which may be 8 to 20 feet and perhaps larger. It is significant to note that the soil-cement column 150 is a uniform mixture of soil and cement and includes fragments of preformed casing 30 which acted as a sacrificial guide as column 150 was formed.

Figure 8:
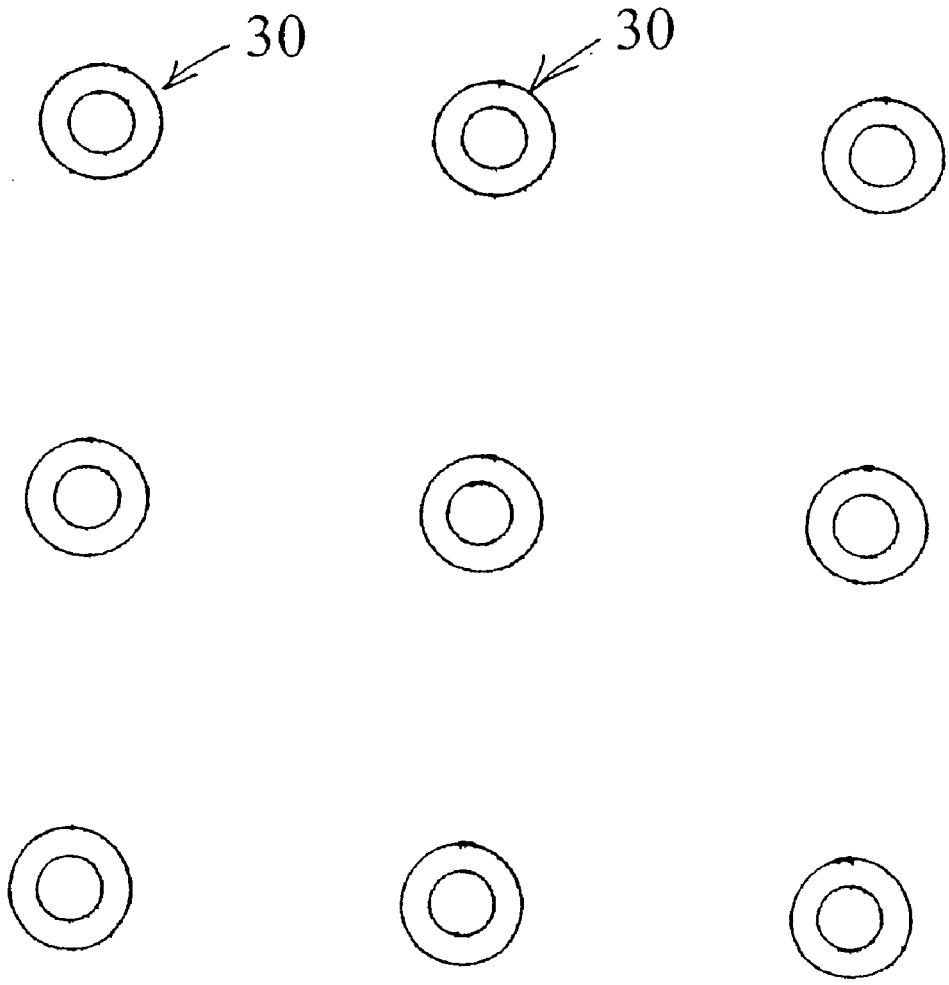
FIG. 8 illustrates an array of sacrificial guides which have been laid out in a grid-like pattern.

FIG. 8 illustrates an array of preformed casings 30 which have been laid out in a grid-like pattern with the centers of the casings aligned vertically and horizontally and spaced equidistantly from each other.

Figure 9:
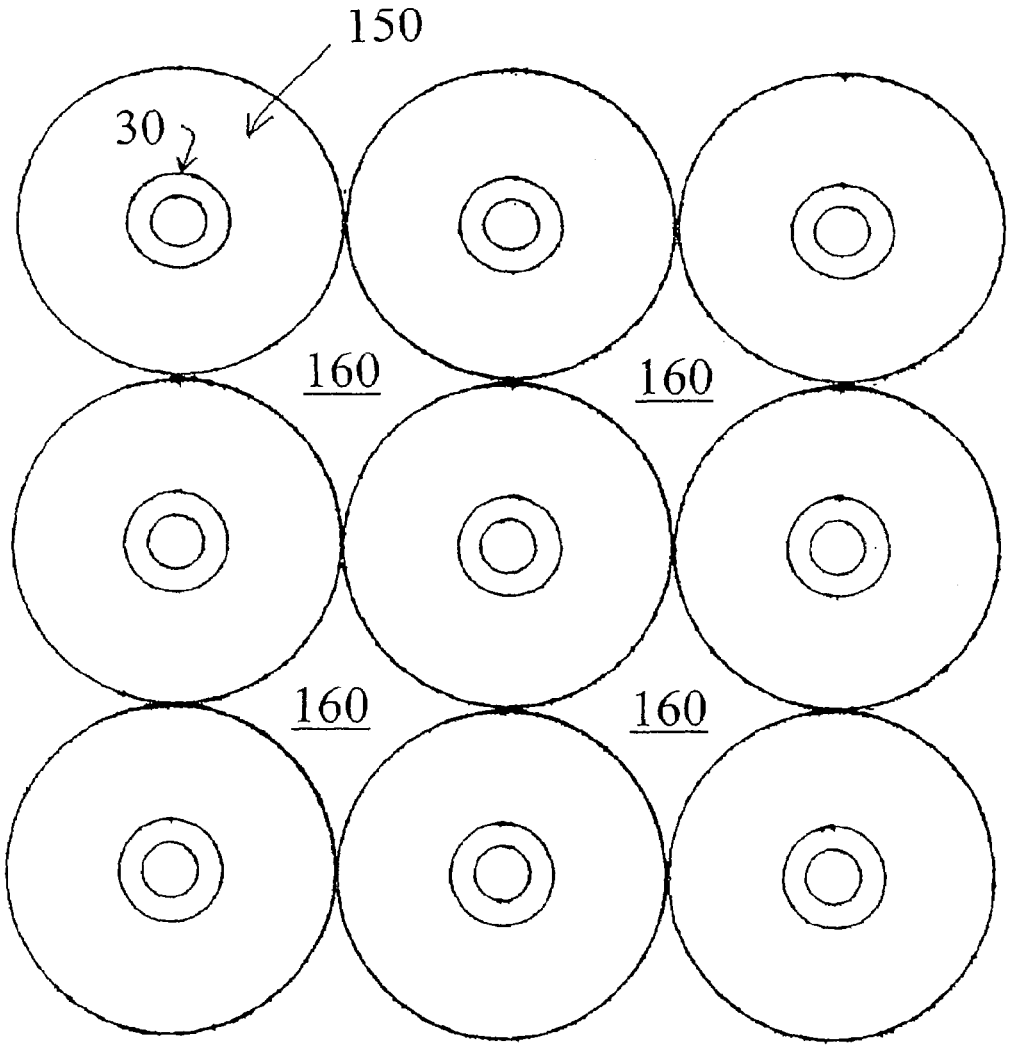
FIG. 9 illustrates schematically the diameter of large soil-cement columns 150 to be formed using the casings 30 as sacrificial guides.

FIG. 9 illustrates schematically the diameters of the large columns 150 to be formed using casings 30 as sacrificial guides. FIG. 9 illustrates the sacrificial guides in place for clarity, it being understood that guides 30 are eliminated when soil-cement columns 150 are formed.

It is significant to note the open regions or interstitial spaces shown as 160 in FIG. 9 as being those regions between soil-cement columns 150. In many applications, it is important to process as much of open regions 160 as possible.

Figure 10:
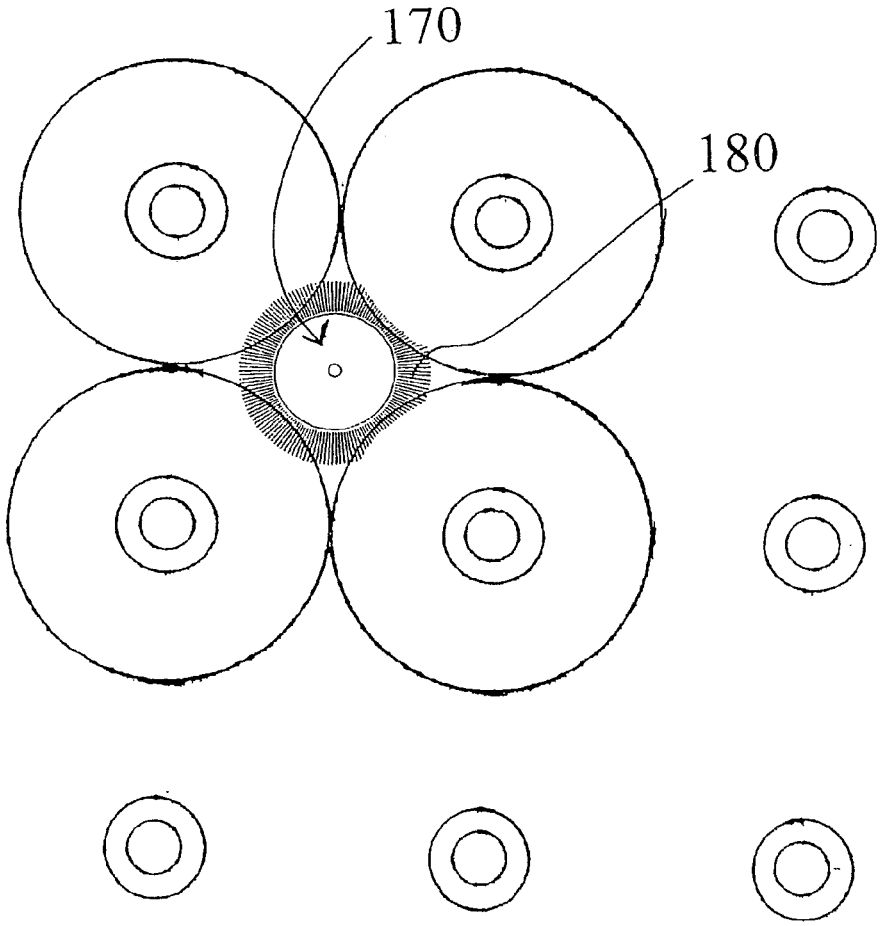
FIG. 10 illustrates one method of hardening or solidifying the interstitial spaces between large soil-cement columns illustrated in FIG. 9.

FIG. 10 illustrates the use of my invention described in U.S. Pat. No. 6,241,426 for processing the interstitial spaces 160 shown in FIG. 9. Generally speaking, a smaller tool is utilized to form smaller soil-cement columns 170 in the interstitial spaces 160. In the process of forming soil-cement columns 170, one or more high pressure radially outwardly directed nozzles are utilized to create a soil cement mixture in the hydraulically extended regions shown as 180, as more fully shown and described in U.S. Pat. No. 6,241,426 (FIG. 8).

FIG. 11 illustrates another embodiment wherein casings 130 are formed in offset patterns where the centers of any three adjacent holes form an equilateral triangle.

Figure 12:
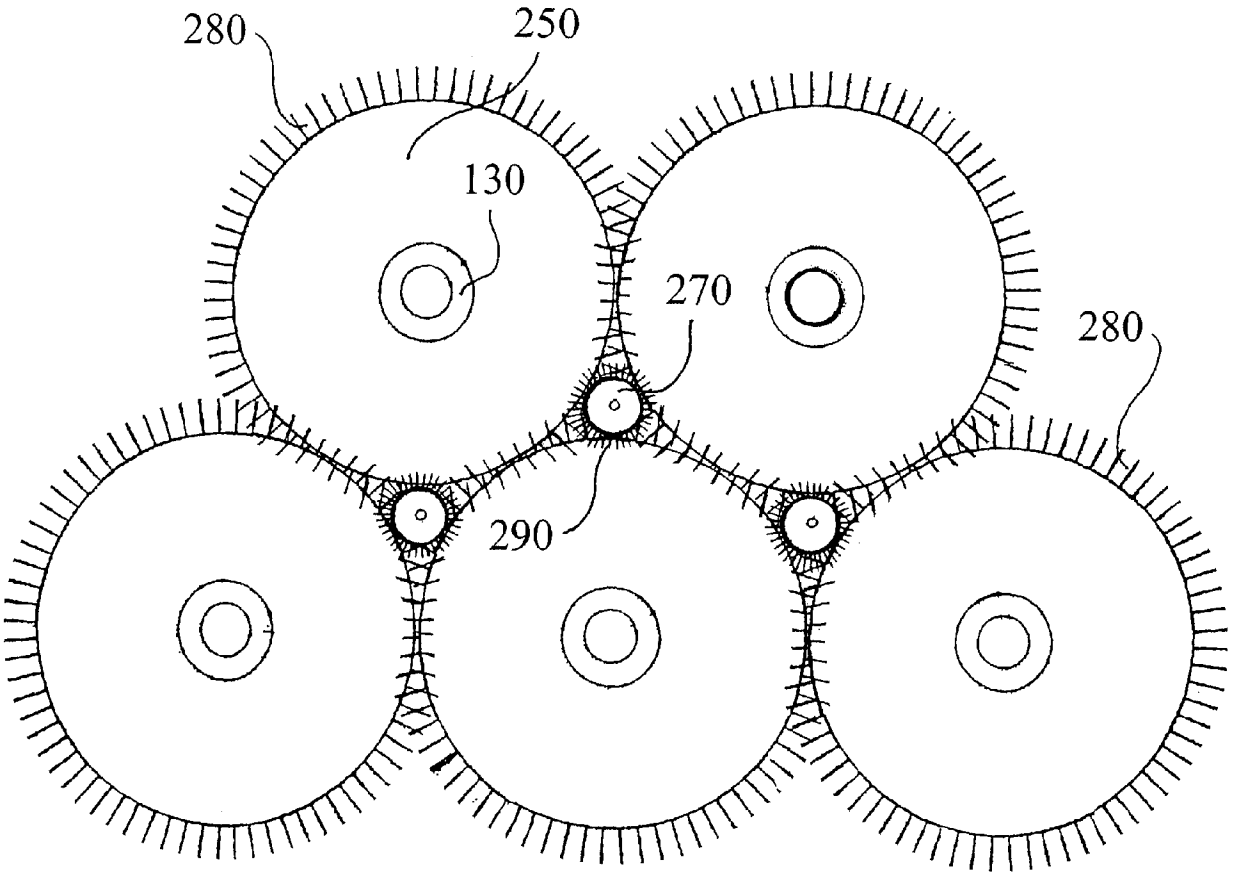
FIG. 12 illustrates an embodiment of the invention intended to solidify or harden or otherwise process virtually 100% of the soil in the subterranean earth situs being treated.

FIG. 12 illustrates an embodiment intended to solidify or process 100% of the soil as may be required in either the hardening of soil for an airport runway, or in the treatment of an underground radioactive plume. Soil-cement columns 250 have been formed using the triangular placement of casings 130. In the embodiment shown in FIG. 12, each of the large scale tools (not shown) used to form columns 250 has been outfitted with an extender nozzle as shown in FIG. 8 of U.S. Pat. No. 6,241,426, which "extends" the radius of each column 250 by up to one foot. The columns 250 are centered so that the peripheries of adjacent columns 250 are as close together as possible. The "extended" regions 280 overlap to insure processing of the highest possible percentage of the soil in the situs. In addition, smaller tools are thereafter used to form soil-cement columns 270 in the interstitial spaces between "extended" columns 250. The tools used to form smaller soil-cement columns also preferably use "extenders" to process the regions shown as 290. The pattern shown in FIG. 12 is simply repeated throughout the situs and will effectively process 100% of the soil in the situs. Other geometries may be utilized to obtain 100% effectiveness, particularly when the large tools are outfitted with "extender" nozzles.

Figure 13:
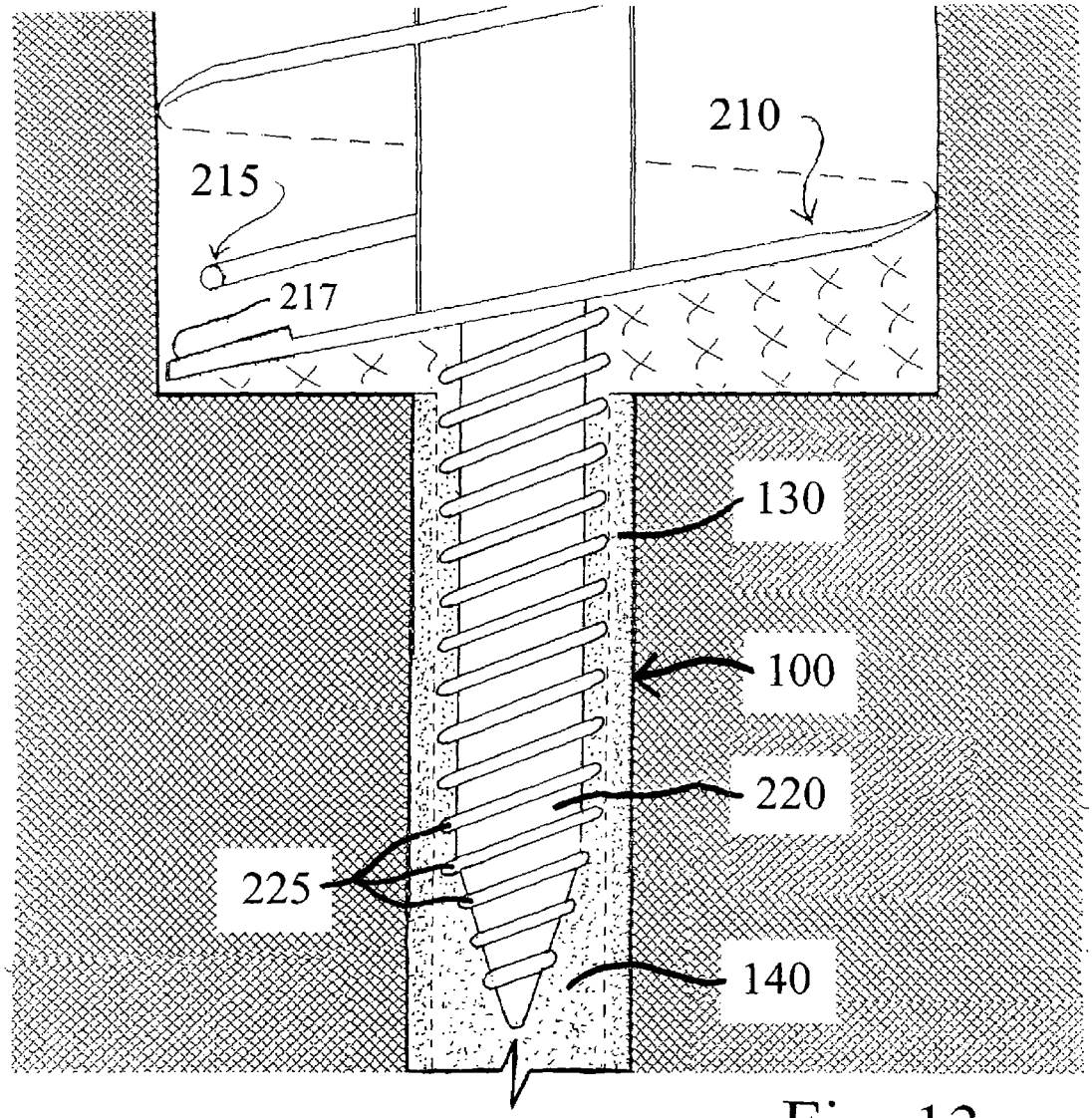
FIG. 13 illustrates an alternate embodiment using a solid cylindrical sacrificial guide.

FIG. 13 illustrates an alternate embodiment of the invention using a solid sacrificial guide 100 having a first, outer region 130 which is relatively hard and a second, central region 140 which is relatively soft. The large soil processing tool 210 has a pilot 220 tipped with an auger 225. The auger 225 drills out the soft second region 140 of guide 100. The first region 130 guides auger 220 and guides the large tool 210 as it advances downwardly. Cutting tip 217 and nozzle 215 work together to break up and fragment the underground material.

In forming an array of soil-cement columns as described above, if any pilot hole is improperly located or not drilled with required verticality, various corrective measures can be taken. A new pilot hole may be properly centered and drilled, and the sacrificial guide of the first hole is simply broken away to the extent necessary and forms part of the new sacrificial guide. Another corrective measure is to form soil cement columns in any regions of the initial array which are not treated because of error.

The foregoing description of the invention has been presented for purposes of illustration and description and is not intended to be exhaustive or to limit the invention to the precise form disclosed. Modifications and variations are possible in light of the above teaching. The embodiments were chosen and described to best explain the principles of the invention and its practical application to thereby enable others skilled in the art to best use the invention in various embodiments and with various modifications suited to the particular use contemplated. The scope of the invention is to be defined by the following claims.

What is claimed is:

1. A method for forming a large diameter, subterranean soil cement column in material located in a subterranean earth situs utilizing a large diameter soil processing tool with a pilot in conjunction with a preformed sacrificial guide, comprising the steps:

forming a sacrificial guide by advancing and rotating a small diameter soil processing tool into said situs to break said material into pieces, said small diameter soil processing tool forming a hole as it advances;

while advancing said small diameter soil processing tool into said situs, introducing a cement slurry into said pieces from said tool at a velocity sufficient to hydraulically divide said pieces into particles and mix said cement slurry with said particles to form a soil-cement slurry, said soil-cement slurry containing cementitious solids, soil particles and free water;

withdrawing said small diameter soil processing tool from said situs;

while withdrawing said small diameter soil processing tool, rotating said tool at a rotational speed to exert a centrifugal force by said tool upon said soil-cement slurry in excess of two G's, whereby said centrifugal force causes the solids of said soil-cement slurry to migrate further from the center of said hole than said free water to form a first cylindrical region at the outer edges of said hole and a second cylindrical region at the center of said hole, said first region having a smaller proportion of free water than said second region;

allowing said mixture in said hole to set up;

advancing said pilot of said large diameter soil processing tool into said second region of said sacrificial guide;

driving said tool downwardly, and forming a large diameter soil-cement column by physically and hydraulically dividing said material into particles and mixing cement slurry with said particles; and breaking said sacrificial guide with said large diameter soil processing tool, whereby said sacrificial guide fragments are mixed into and become part of said soil-cement column formed by said large diameter soil processing tool.

2. The method of claim 1 comprising the further step:

drilling out said second region of said sacrificial guide before advancing said pilot into said second region.

3. The method of claim 1 wherein said pilot is tipped with an auger and said auger is adapted to drill out said second region of said sacrificial guide as said tool is advanced.

* * * * *